US006637508B2

(12) United States Patent
Marsh et al.

(10) Patent No.: US 6,637,508 B2
(45) Date of Patent: Oct. 28, 2003

(54) MULTI-SHOT TUBING PERFORATOR

(75) Inventors: Brent Marsh, Bournemouth (GB); Robert Parker, Weymouth (GB); Timothy David Pollock, Bridport (GB)

(73) Assignee: Varco I/P, Inc., Houston, TX (US)

( * ) Notice: Subject to any disclaimer, the term of this patent is extended or adjusted under 35 U.S.C. 154(b) by 0 days.

(21) Appl. No.: 09/982,947

(22) Filed: Oct. 22, 2001

(65) Prior Publication Data

US 2003/0075316 A1 Apr. 24, 2003

(51) Int. Cl.[7] ..... E21B 43/112
(52) U.S. Cl. ..... 166/55.2; 166/55.8; 166/321
(58) Field of Search ..... 166/55, 55.2, 55.8, 166/321, 298; 175/267; 83/660, 30

(56) References Cited

U.S. PATENT DOCUMENTS

| | | | | |
|---|---|---|---|---|
| 3,720,262 A | * | 3/1973 | Grable | 166/298 |
| 4,691,779 A | * | 9/1987 | McMahan et al. | 166/321 |
| 4,979,567 A | * | 12/1990 | Rubbo | 166/297 |
| 5,875,840 A | * | 3/1999 | Dietle | 166/55 |
| 6,155,150 A | | 12/2000 | Cooper et al. | 83/13 |

FOREIGN PATENT DOCUMENTS

| | | |
|---|---|---|
| EP | 0 585 142 B1 | 2/1994 |
| EP | 0 604 568 B1 | 7/1994 |
| EP | 0 787 889 A2 | 8/1997 |
| EP | 0 791 721 A1 | 8/1997 |
| EP | 0 791 723 A1 | 8/1997 |
| EP | 0 796 980 A2 | 9/1997 |
| EP | 0 859 126 A2 | 8/1998 |
| GB | 2 289 297 | 11/1995 |
| GB | 2 296 924 | 7/1996 |
| GB | 2 296 925 | 7/1996 |
| GB | 2 297 107 | 7/1996 |
| GB | 2 340 158 | 2/2000 |
| WO | WO 00/58599 | 10/2000 |

* cited by examiner

*Primary Examiner*—David Bagnell
*Assistant Examiner*—Zakiya Walker
(74) *Attorney, Agent, or Firm*—Finnegan, Henderson, Farabow, Garrett & Dunner, L.L.P.

(57) ABSTRACT

A perforator apparatus for repeated punching of holes at a multiple of selected locations in tubing of a well bore. The apparatus is activated for repeated punching operations by a fluid control valve mechanism that controls opposed directional movement of a piston connected to a punch of the perforator apparatus.

17 Claims, 4 Drawing Sheets

MULTI-SHOT TUBING PERFORATOR

BACKGROUND OF THE INVENTION

The present invention relates to a multi-shot punch perforator for use in punching holes in tubing within a well bore, and a hydraulic control valve for use therewith.

In oil and gas drilling operations, it is common practice to use a wireline for raising and lowering tools into the well bore. Specifically, this is achieved by attaching a toolstring to the end of a reel of a single strand or braided wire. By reeling out the wire, the toolstring may be lowered to the desired location within the well. The toolstring consists of a plurality of individual tools connected together to form a working unit. These tools may include data-retrieving devices and devices for performing other functions with respect to the well bore tubing, including punching openings in the tubing for various purposes including accessing lateral bores extending from the vertical well bore into which the toolstring is inserted.

In applications wherein punching is to be performed, prior art devices used for this purpose require removal from the well bore after each punching operation to ready the punching device for the next operation thereof. This constitutes a cumbersome and time-consuming operation.

The present invention provides a multi-shot punch perforator mechanism, and hydraulic control valve for use in activating the same, wherein multiple punching operations may be performed without requiring removal of the punch perforator from the well bore.

SUMMARY OF THE INVENTION

A fluid control mechanism is provided in accordance with the invention that selectively controls opposed directional movement of a piston. This mechanism may be used with the punch perforator in accordance with the invention. Specifically, the piston thereof is used to activate the punch of the punch perforator.

The piston is adapted for linear movement in opposed directions within the housing. A first valve is provided for selectively metering fluid to a first side of the piston to move the piston linearly within the housing in a first direction, and to selectively prevent fluid flow to the first side of the piston to permit the piston to move linearly within the housing in a second direction opposed to the first direction. A second valve is provided for preventing fluid flow to a second side of the piston opposite the first side thereof during metering of fluid flow to the first side of the piston by the first valve, and for metering fluid flow to the second side of the piston when the fluid flow to the first side of the piston is prevented by the first valve to move the piston in the second direction.

With this fluid control valve mechanism, the fluid flow is metered in a common direction by the first valve and by the second valve selectively to the first side of the piston and to the second side of the piston, respectively.

The housing is tubular and the fluid flow is metered by the first valve through an annular fluid passage within this housing. The second fluid flow is metered by the second valve through a tubular fluid passage extending linearly through the annular fluid passage.

The first and second valves may be positioned within the housing at a location remote from the piston and opposite the first side thereof.

The first valve and the second valve are adapted for linear movement between open and closed positions within the housing in response to selected pressure of fluid flow within the housing.

The fluid flow may be of a liquid or gas.

The housing of the mechanism may be positioned within a well bore.

The mechanism, including the housing thereof, may be a component of a toolstring.

The perforator apparatus for punching holes in tubing within a well bore includes a punch mounted within a housing adapted for positioning within tubing of the well bore. An opening is provided in the housing that is aligned with the punch. Hydraulic control means within the housing are provided for selectively moving the punch through the opening and into punching contact with the tubing to punch a hole therein. Thereafter, the hydraulic control means returns the punch to the position within the housing. In this manner, the punch may be operated to perform repeated punching operations without requiring removal of the mechanism from the well bore and associated tubing.

The hydraulically controlled means of the perforator apparatus may include a movable ram connected to the punch to transfer force to the punch sufficient to punch the hole in the tubing.

This hydraulically controlled means may further include a hydraulic control valve for controlling movement of the ram relative to the punch.

The ram is mounted within the housing for selective linear movement therein toward and away from the punch by the hydraulic control valve.

Means are provided for preventing movement of the housing within the tubing during punching thereof by the punch.

The punch may be retained in a holder positioned on a tapered track connected to the ram.

In operation of the perforator apparatus, the ram during selective linear movement thereof away from the punch causes the tapered track to correspondingly move to thereby extend the punch through the opening into punching engagement with the tubing. Thereafter, the ram during selective linear movement thereof toward the punch causes the tapered track to correspondingly move to thereby retract the punch back through the opening and into the housing. In this manner, the punch is positioned and ready for additional punching operations.

The hydraulic control valve may operate at least one piston acting on the ram to impart the movement to the ram relative to the punch.

The means for preventing movement of the housing during the punching operation may include a plurality of hydraulically operated anchoring slips that operate to engage the tubing during punching thereof by the punch and thereafter disengage from the tubing upon completion of the punching operation.

In a preferred aspect of the invention, the perforator apparatus may include a punch mounted within a housing adapted for positioning within tubing of the well bore, an opening in the housing aligned with the punch, and hydraulically controlled means within the housing for selectively moving the punch through the opening and into punching contact with the tubing to punch a hole therein, and thereafter returning the punch to the position within the housing. The hydraulically controlled means may include a piston adapted for linearly movement in opposed directions within the housing. A first valve is provided for selectively metering liquid flow to a first side of the piston to move the piston linearly within the housing in a first direction, and to selectively prevent liquid flow to the first side of the piston to permit the piston to move linearly within the housing in a second direction opposed to the first direction. A second valve may be provided for preventing liquid flow to a second side of the piston opposite the first side thereof during metering of fluid flow to the first side of the piston by the first valve, and for metering liquid flow to the second side of the piston when the liquid flow to the first side of the piston is prevented by a first valve to move the piston in the second direction.

Perforator apparatus may include metering of the liquid flow in a common direction by the first valve and by the second valve selectively to the first side of the piston and to the second side of the piston, respectively.

The housing of the perforator apparatus is tubular and the liquid flow is metered by the first valve through an annular liquid passage within the housing, and the second liquid flow is metered by the second valve through a tubular liquid passage extending linearly through the annular fluid passage.

The first valve and the second valve may be positioned within the housing at a location remote from the piston and opposite the first side thereof.

The first valve and the second valve are adapted for linear movement between opened and closed positions within the housing in response to selected pressure of liquid flow within the housing.

These four components of the punch perforator are connected as indicated by the arrows to constitute the assembly of the perforator apparatus.

DESCRIPTION OF THE PREFERRED EMBODIMENTS

Figure 1:
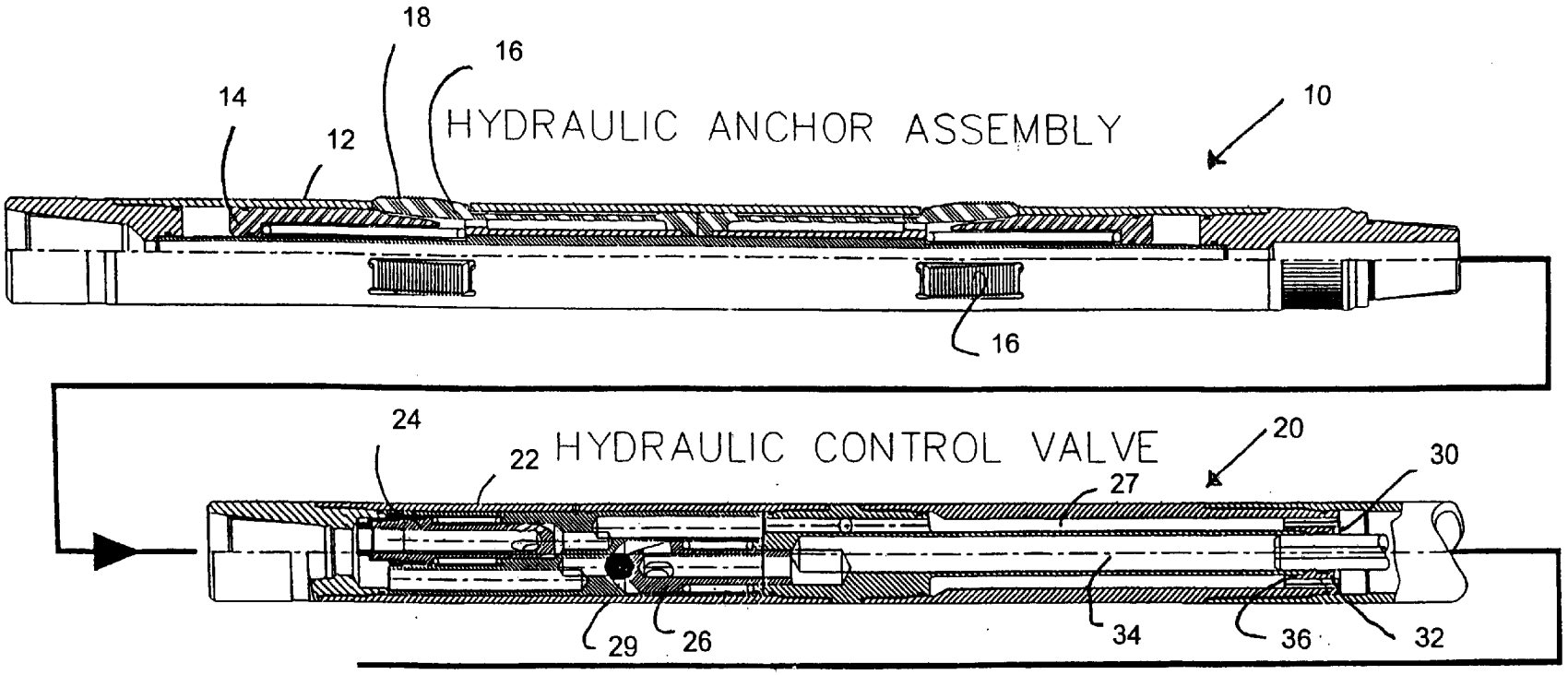
FIG. 1 is a partial sectional view of the hydraulic anchor assembly and hydraulic control valve components of the punch perforator.

With reference to FIG. 1 of the drawings, a coiled tubing anchor assembly, designated as 10, is activated by internal liquid pressure. Specifically, within the housing 12 of this assembly there is provided a piston 14 and anchoring slips 16 having serrations 18 on the outer surface thereof.

By applying a selected pressure to the piston 14 within the housing 12, the piston moves linearly to cause the slips 16 to move radially into contact with the wall of the tubing (not shown). The serrations 18 with the slip in this position anchor the device to the tubing. This permits accuracy of punching by the associated punch mechanism. Upon completion of this operation, the coiled tubing pressure is reduced and the slips are then free to retract away from the tubing wall and thus release the anchor assembly and associated toolstring components so that the toolstring components may be moved to a new location within the well bore. The operation may then be repeated to permit anchoring for an additional punching operation.

The hydraulic anchor assembly 10 is connected to a hydraulic control valve, designated generally as 20. The hydraulic control valve 20 includes a housing 22 within which is provided a velocity flow valve 24 and a check valve 26. Also, within the housing, there is provided an annular passage 27 that provides fluid flow to side 30 of a piston 32. Likewise, a central passage 34 provides for fluid flow to the opposite side 36 of the piston 32.

At a controlled flow rate/pressure differential, the velocity flow valve 24 is open and flow is directed to side 30 of the piston 32 and to the side 48*a* of piston 48. This maintains the punch 60 in a retracted position. The check valve 26 is closed and therefore blocks flow to the central passage 34. Therefore, no pressure is acting upon side 48*b* or 67*b* of the pistons 48 and 67, respectively. This has the effect of generating a force on the piston 48 to move it downwardly within the housing.

At a higher internal flow rate/pressure differential, the velocity flow valve 24 will close and therefore block flow to the side 48*a* of the piston 48. The check valve 26 opens and flow is directed through passage 34 to sides 48*b* and 67*b* of pistons 48 and 67. This has the effect of generating a force on the pistons to move them upward within the housing.

Figure 2:
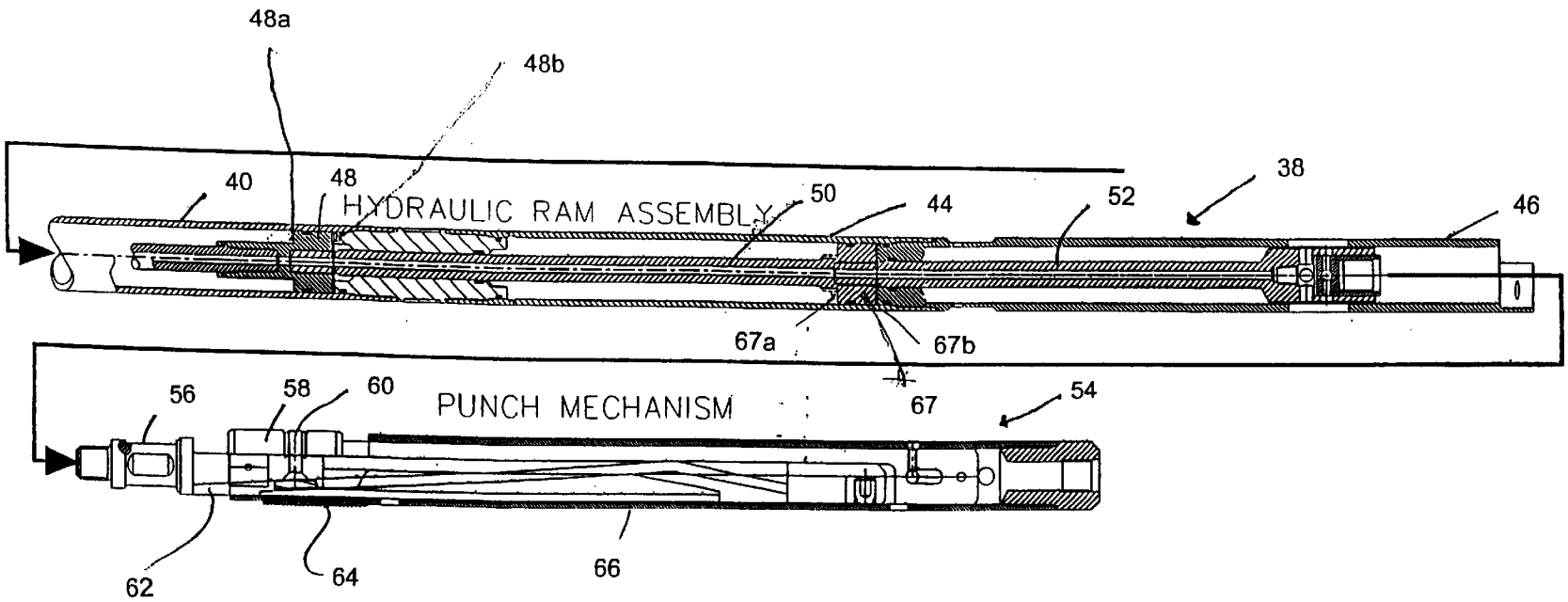
FIG. 2 is a view similar to FIG. 1 of the hydraulic ram assembly and punch mechanism of the punch perforator.
Figures 3A, 3B, 3C:
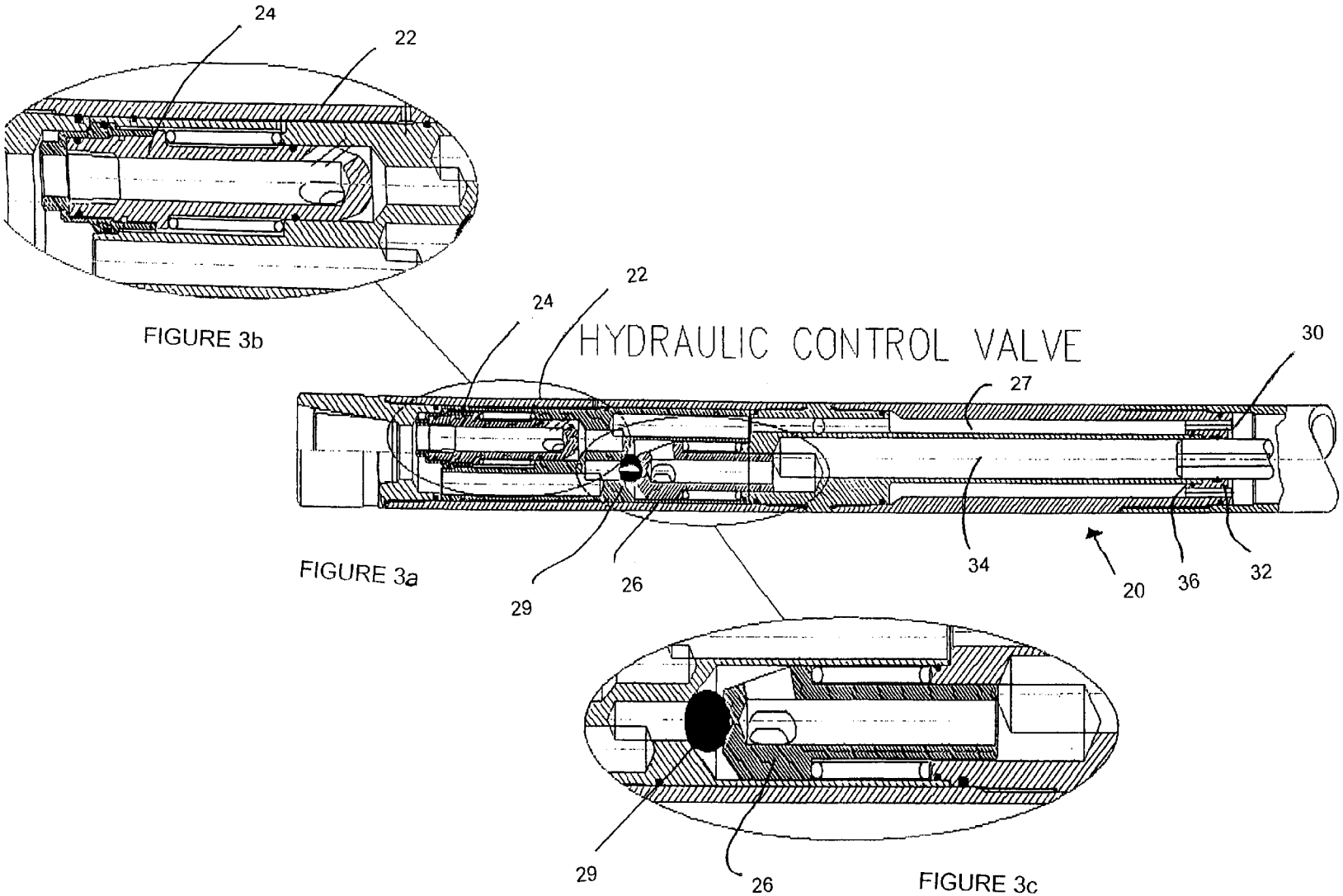
FIG. 3*a* is a partial sectional view of the hydraulic control valve shown in FIG. 1 with designated portions thereof being in enlarged cross-section, as shown in FIGS. 3*b* and 3*c*.
Figure 4:
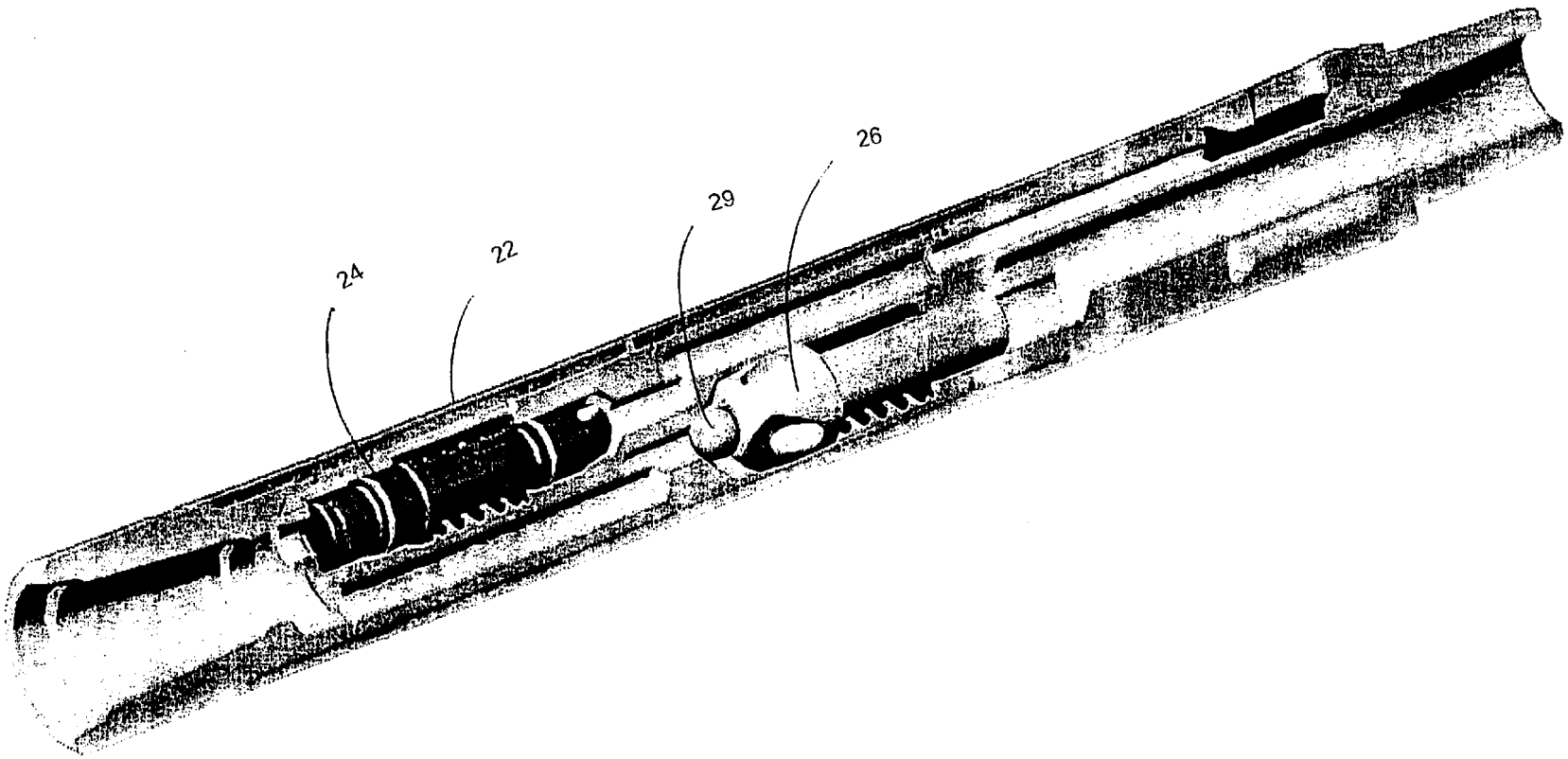
FIG. 4 is a perspective view, with parts broken away, of the hydraulic control valve shown in FIGS. 1 and 3.

With reference to FIG. 2, there is shown a hydraulic ram assembly designated generally as 38. This assembly includes an upper body 40, a middle body 44, a lower body 46, a first piston 48, a second piston 67, and a mandrel 52. The pistons are housed in the upper and middle bodies and link through the mandrel to the punch mechanism, designated generally as 54, at the body 56 thereof. The punch mechanism 54 includes body 56, punch holder 58, punch 60, tapered track 62, in addition to grip serration 64, provided on the housing 66 of the punch mechanism.

In operation, at low flow/pressure differential, the punch mechanism remains inoperative. As flow/pressure differential is increased, the internal pressure acts on the hydraulic anchor assembly, whereby the anchoring slips 16 engage against the wall of the tubing. As flow/pressure differential is further increased, the hydraulic control valve 20 switches low/pressure to the hydraulic ram assembly pistons 48 and 67 to create a force to move them upward. In this manner, the pistons pull the punch mechanism body 56 upward thereby moving tapered track 62 in a like direction to cause the punch 60 to engage the tubing wall and punch a hole in the same.

This action also has the effect of maintaining an opposite force on the housing 66 of the punch mechanism 54 which assists in preventing axial movement of the toolstring during the punching operation.

When the punch passes through the tubing wall and perforates the same, a drop in pressure will result. This serves as an indication that the perforating operation has been completed. The internal pressure is then reduced back to low, circulating pressure. This has the effect of changing back the flow/pressure differential through the hydraulic control valve 20 to return the pistons 48 and 67 to their original position, thus causing retraction of the punch 60 and release of the slips 16. The toolstring may then be moved to another tubing location and be ready for an additional perforating cycle as described above.

What is claimed is:

1. A fluid control valve mechanism for selectively controlling opposed directional movement of a piston, said mechanism comprising:

a piston adapted for linear movement in opposed directions within a tubular housing;

a first valve for selectively metering fluid flow through an annular fluid passage within said housing to a first side of said piston to move said piston linearly within said housing in a first direction, and to selectively prevent fluid flow to said first side of said piston to permit said piston to move linearly within said housing in a second direction opposed to said first direction;

a second valve for preventing fluid flow to a second side of said piston opposite said first side thereof during metering of fluid flow to said first side of said piston by said first valve, and for metering fluid flow through a tubular fluid passage extending linearly through said annular fluid passage to said second side of said piston when said fluid flow to said first side of said piston is prevented by said first valve to move said piston in said second direction; and wherein said first valve and said second valve are positioned within said housing at a position remote from said piston and opposite said first side thereof and said fluid flow is metered in a common direction by said first valve and by said second valve selectively to said first side of said piston and to said second side of said piston, respectively.

2. The mechanism of claim 1 wherein said first valve and said second valve are adapted for linear movement between open and closed positions within said housing in response to selected pressure of fluid flow within said housing.

3. The mechanism of claims 1 or 2, wherein said fluid flow is of a liquid or a gas.

4. The mechanism of claim 3, wherein said housing thereof is positioned within a well bore.

5. The mechanism of claim 4, wherein said housing thereof is a component of a toolstring.

6. A perforator apparatus for punching holes in tubing within a well bore in which the apparatus is positioned comprising:

a punch mounted within a housing and retained in a holder positioned on a tapered track connected to a ram, said housing being adapted for positioning within tubing of a well bore;

an opening in said housing aligned with said punch; and hydraulically controlled means including a movable ram connected to said punch within said housing for selectively moving said punch through said opening and into punching contact with said tubing with force sufficient to punch a hole therein, and thereafter returning said punch to said position within said housing, whereby said punch may be operated to perform repeated punching operations without requiring removal from said well bore and associated tubing.

7. The perforator apparatus of claim 6, wherein said hydraulically controlled means further includes a hydraulic control valve for controlling movement of said ram relative to said punch.

8. The perforator apparatus of claim 7, wherein said ram is mounted within said housing for selective linear movement therein toward and away from said punch by said hydraulic control valve.

9. The perforator apparatus of claim 8, wherein means are provided for preventing movement of said housing within said tubing during punching thereof by said punch.

10. The perforator apparatus of claim 9, wherein said hydraulic control valve operates at least one piston acting on said ram to impart said movement to said ram relative to said punch.

11. The perforator apparatus of claim 10, wherein said means for preventing movement of said housing includes a plurality of hydraulically operated anchoring slips that operate to engage said tubing during punching thereof by said punch and thereafter disengage from said tubing upon completion of punching.

12. The perforator apparatus of claim 6, wherein said ram during selective linear movement thereof away from said punch causes said tapered track to correspondingly move to thereby extend said punch through said opening into punching engagement with said tubing and thereafter said ram during selective linear movement thereof toward said punch causes said tapered track to correspondingly move to thereby retract said punch back through said opening and into said housing, whereby said punch is positioned for additional punching operations.

13. A perforator apparatus for punching holes in tubing within a well bore in which the apparatus is positioned comprising:

a punch mounted within a housing adapted for positioning within tubing of a well bore;

an opening in said housing aligned with said punch;

hydraulically controlled means within said housing for selectively moving said punch through said opening and into punching contact with said tubing to punch a hole therein, and thereafter returning said punch to said position within said housing;

said hydraulically controlled means including a piston adapted for linear movement in opposed directions within said housing;

a first valve for selectively metering liquid flow to a first side of said piston to move said piston linearly within said housing in a first direction, and to selectively prevent liquid flow to said first side of said piston to permit said piston to move linearly within said housing in a second direction opposed to said first direction; and a second valve for preventing liquid flow to a second side of said piston opposite said first side thereof during metering of liquid flow to said first side of said piston by said first valve, and for metering liquid flow to said second side of said piston when said liquid flow to said first side of said piston is prevented by said first valve to move said piston in said second direction.

14. The perforator apparatus of claim 13, wherein said liquid flow is metered in a common direction by said first valve and by said second valve selectively to said first side of said piston and to said second side of said piston, respectively.

15. The perforator apparatus of claim 14, wherein said housing is tubular and said liquid flow is metered by said first valve through an annular liquid passage within said housing, and said second liquid flow is metered by said second valve through a tubular liquid passage extending linearly through said annular fluid passage.

16. The perforator apparatus of claim 13, 14 or 15, wherein said first valve and said second valve are positioned within said housing at a location remote from said piston and opposite said first side thereof.

17. The perforator apparatus of claims 13, 14, 15 or 16, wherein said first valve and said second valve are adapted for linear movement between open and closed positions within said housing in response to selected pressure of liquid flow within said housing.

* * * * *